US007611749B2

(12) United States Patent
Zhan

(10) Patent No.: US 7,611,749 B2
(45) Date of Patent: Nov. 3, 2009

(54) METHOD AND APPARATUS FOR APPLYING FLOCKING TO THE OUTSOLE OF SHOE UNDER PRESSURE

(75) Inventor: Jie Zhan, Putian (CN)

(73) Assignee: Vida Shoes International, Inc., New York, NY (US)

( * ) Notice: Subject to any disclaimer, the term of this patent is extended or adjusted under 35 U.S.C. 154(b) by 189 days.

(21) Appl. No.: 11/769,442

(22) Filed: Jun. 27, 2007

(65) Prior Publication Data

US 2008/0066240 A1 Mar. 20, 2008

Related U.S. Application Data

(60) Provisional application No. 60/825,985, filed on Sep. 18, 2006.

(51) Int. Cl.
*B05D 1/16* (2006.01)

(52) U.S. Cl. ..... 427/206; 427/200

(58) Field of Classification Search ..... 427/206
See application file for complete search history.

(56) References Cited

U.S. PATENT DOCUMENTS 2,271,888 A * 2/1942 Manley ..... 427/282
4,879,969 A * 11/1989 Haranoya et al. ..... 118/638
4,899,411 A * 2/1990 Johnson et al. ..... 12/142 R

* cited by examiner

*Primary Examiner*—Frederick J Parker
(74) *Attorney, Agent, or Firm*—Levine & Mandelbaum

(57) ABSTRACT

Flocking fibers are applied to the outsole of a shoe by placing the fibers in a chamber within a housing and placing the outsole over an opening in the housing after applying an adhesive to a surface of the outsole which is to receive the flocking. A pressurized gas jet is activated to increase the pressure in the housing thereby causing the fibers to exit the chamber and collide with the adhesive surface of the outsole. The outsoles may be supported on screens within openings in a tray which is removably mountable on the housing over the opening therein.

9 Claims, 5 Drawing Sheets

METHOD AND APPARATUS FOR APPLYING FLOCKING TO THE OUTSOLE OF SHOE UNDER PRESSURE

BACKGROUND OF THE INVENTION

The present invention provides for an apparatus and a method for applying flocking to the outsole of a shoe. More specifically, the invention is directed to a method for applying flocking to the outsole of a shoe without the need for electrical grids or apparatus for interposing an electrical field between the outsole of a shoe and a supply of flocking.

It is known in the art of shoe manufacture to apply flocking to the upper of a shoe or to the outsole of the shoe. The present invention is concerned with the application of flocking to the outsole of a shoe in order to achieve a decorative effect and/or for comfort.

U.S. Pat. No. 7,056,558 for a Fabric Shoe Outsole Manufacturing Method by Electrostatic Flocking covers a process for applying flocking to the outsole of a shoe by dropping fibers through a screen placed above the outsole. The screen electrically charges the fibers. The charge on the fibers causes them to align in a desired way before they become embedded in an adhesive that has been applied to the outsole in order to provide an aesthetically pleasing appearance.

U.S. Patent Publication No. U.S. 2004/006890 A1 for a Shoe with Slip-Resistant, Flocked Fabric Outsole teaches the construction of a shoe having an outsole to which a multitude of finely cut, relatively short, flock fibers is applied over an adhesive coating.

U.S. Pat. No. 4,899,411 to Johnson et al. for a Process For Applying a Flocked Coating to a Cloth Surface such as a Tennis Shoe discloses a process for applying flocking to the upper of a tennis shoe and indicates that an electrostatic field can be used to apply flocking.

Japanese patent application no. JP10100287A discloses a method of affixing multicolored flocking to boot uppers. A mask is sprayed onto the uppers which are then sprayed with black urethane paint which penetrates holes in the mask. A leopard pattern is achieved by the process.

U.S. Pat. No. 4,287,629 for a Process and Apparatus for the Production of Synthetic Chamois Leather Footwear discloses a process which uses plastic injection molding to form footwear uppers. The uppers are then coated with adhesive, and are then flocked in a flocking machine. The flocking machine used to apply the flocking depends on electrostatic attraction.

Japanese patent publications nos. 5,147,137 and 8,205,901 are directed to methods of applying flocking to a shoe after first coating the shoe with an adhesive.

All of the prior art methods are potentially dangerous in requiring the application of voltages to form electrostatic fields, or in shooting flocking through pneumatic guns which can cause injury to workers practicing the methods.

SUMMARY OF THE INVENTION

The present invention seeks to overcome the aforementioned disadvantages of the prior art in providing an apparatus and method for applying flocking to the outsoles of shoes wherein the flocking is stored in an enclosed pressure chamber having openings which can be covered by the surfaces of the outsoles to be flocked after the surface are coated with an adhesive. As air is applied to the interior of the chamber under pressure, the flocking fibers are propelled through the openings covered by the outsoles. As the flocking fibers impinge upon the glue covered surfaces of the outsoles, the change in momentum causes the fibers to become embedding in the glue which is then dried and set by application of heat.

This air pressure flocking method can be used to apply flocking over the entire outer surface of the outsole of a shoe. Alternatively, flocking can be applied to predetermined areas of the outsole by masking those areas to which no flocking is to be applied.

The above features and objects, and other advantages of the present invention will be more clearly understood from the following detailed description considered in conjunction with the accompanying drawings, in which like reference numerals are used to indicate like parts in the various views.

DESCRIPTIONS OF THE DRAWINGS

Figure 4:
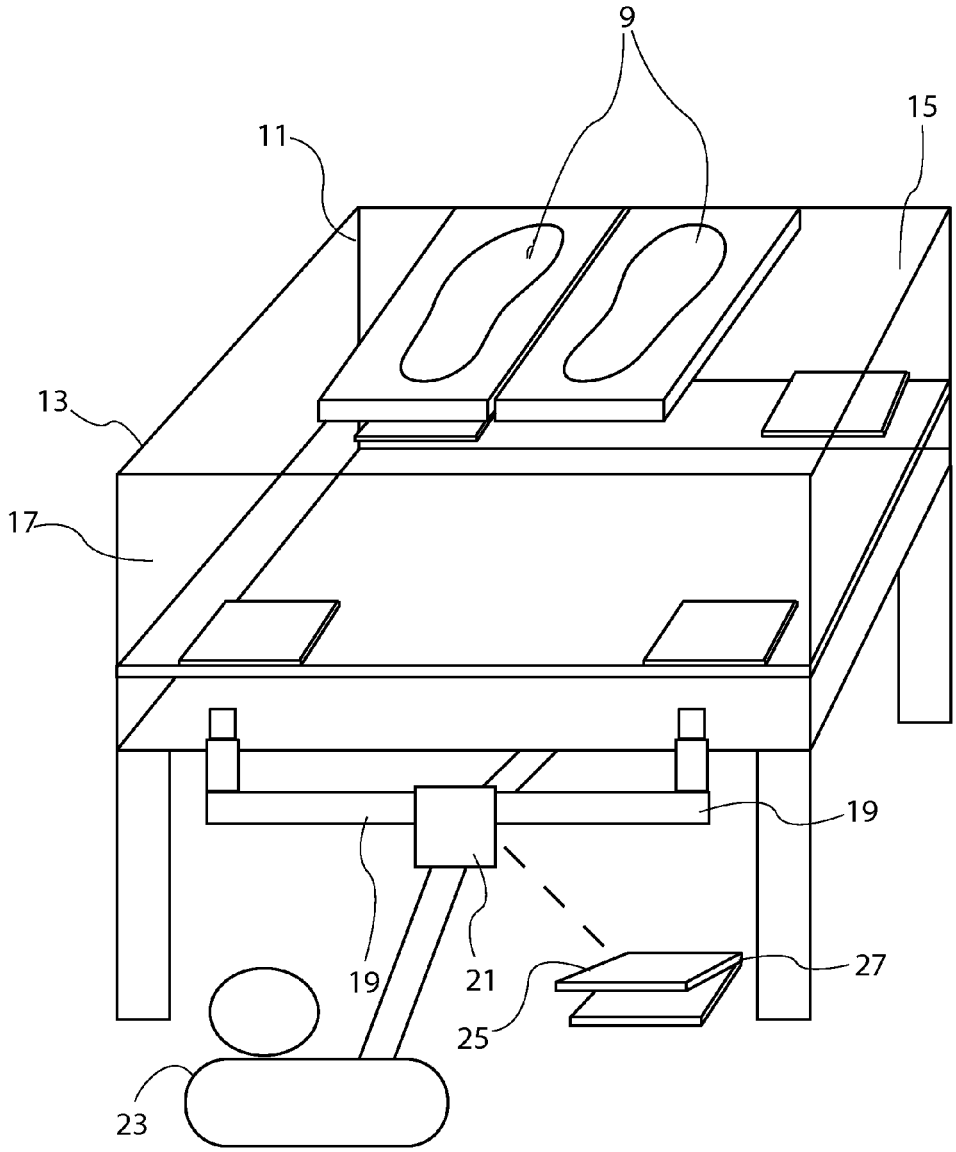
FIG. 4 is a perspective view showing an apparatus of the invention for use at a station at which flocking is applied to the pair of outsoles in FIG. 1 in accordance with the invention.
Figure 4A:
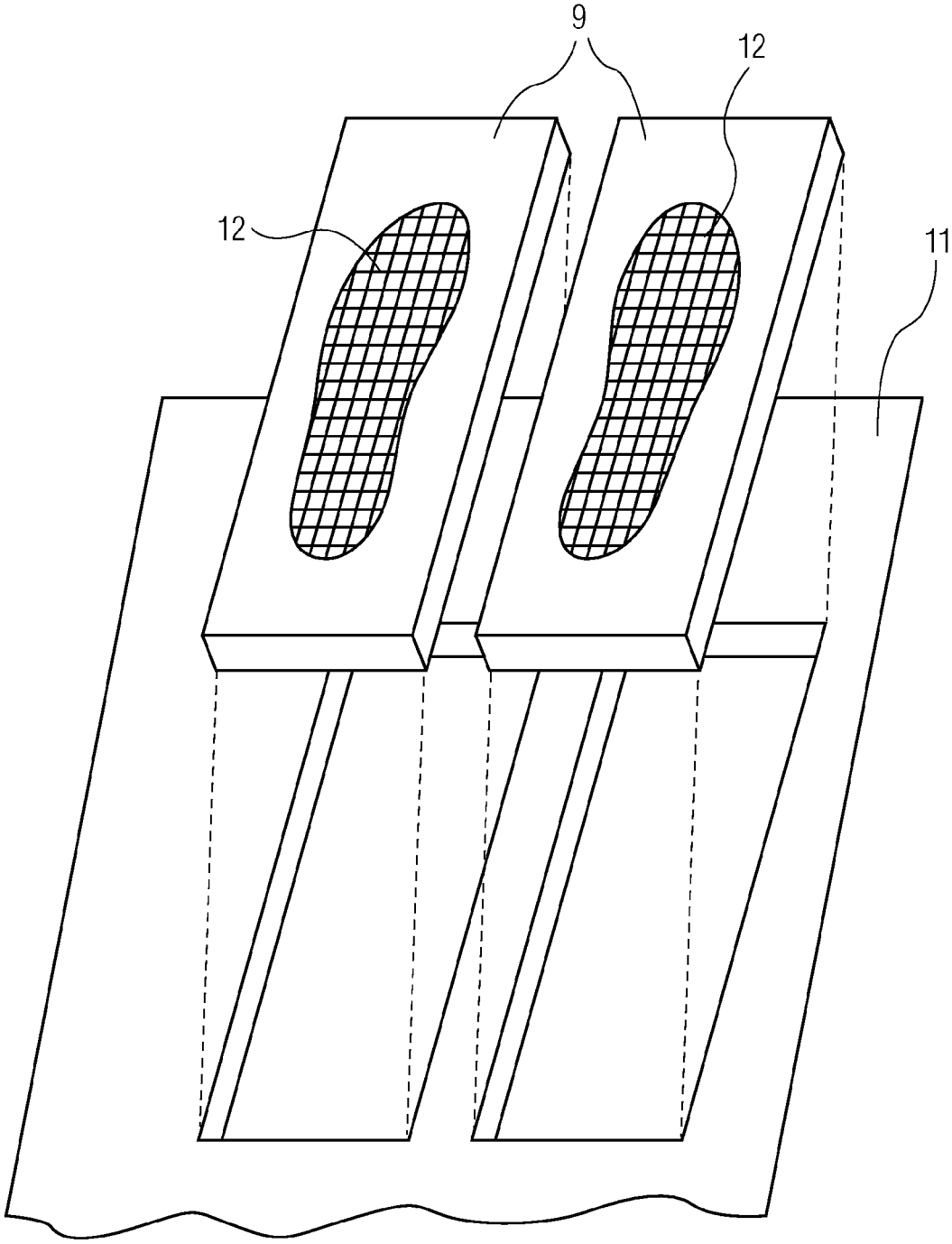
Figure 5:
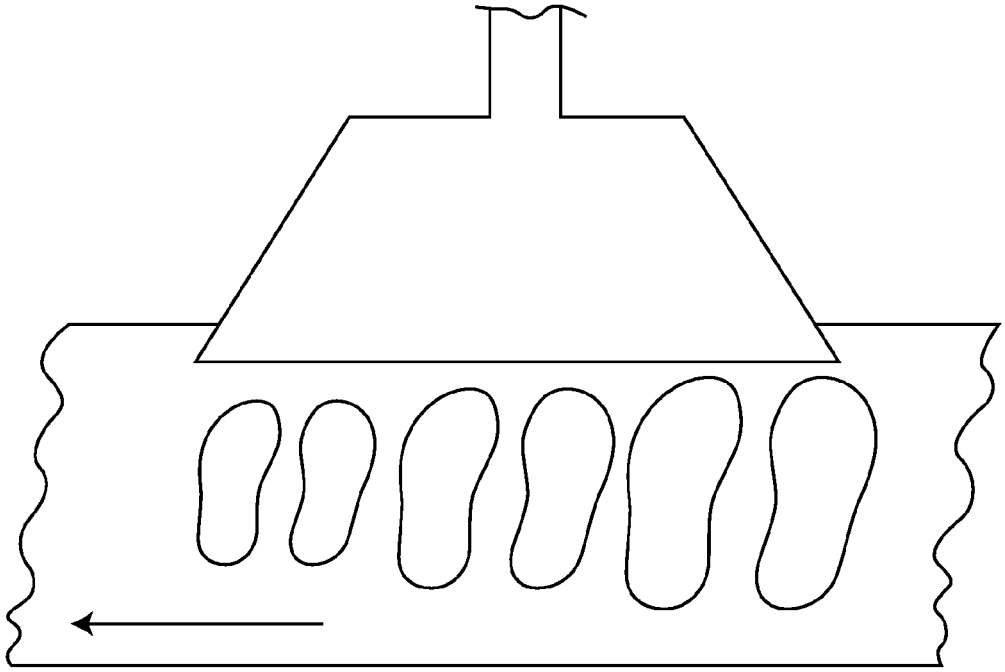
Figure 6:
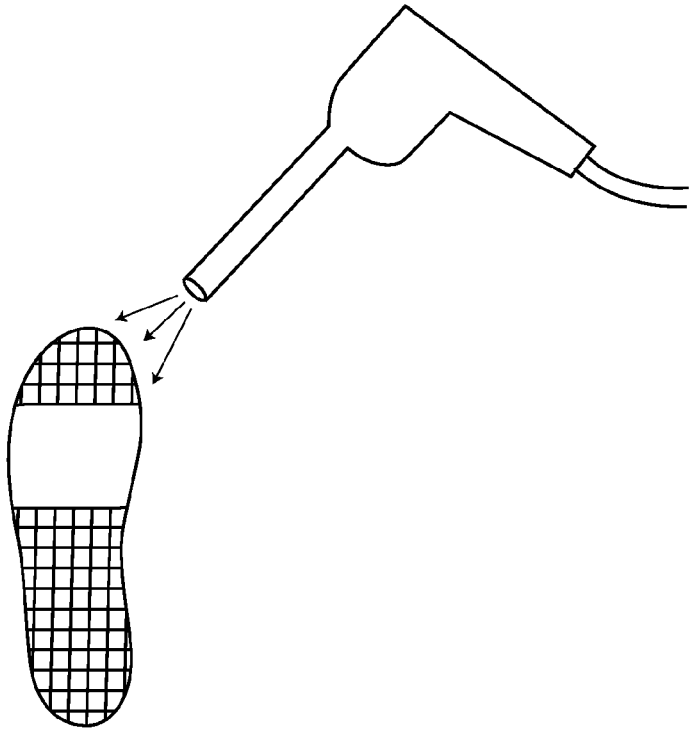

FIG. 4*a* is an exploded perspective view showing a portion of the apparatus of FIG. 4;

FIG. 5 is a perspective view showing a stage of the method of the invention after flocking has been applied to outsoles in accordance with the invention;

FIG. 6 is a perspective view showing an outsole during a finishing stage according to the invention.

DESCRIPTION OF THE PREFERRED EMBODIMENT

Figure 1:
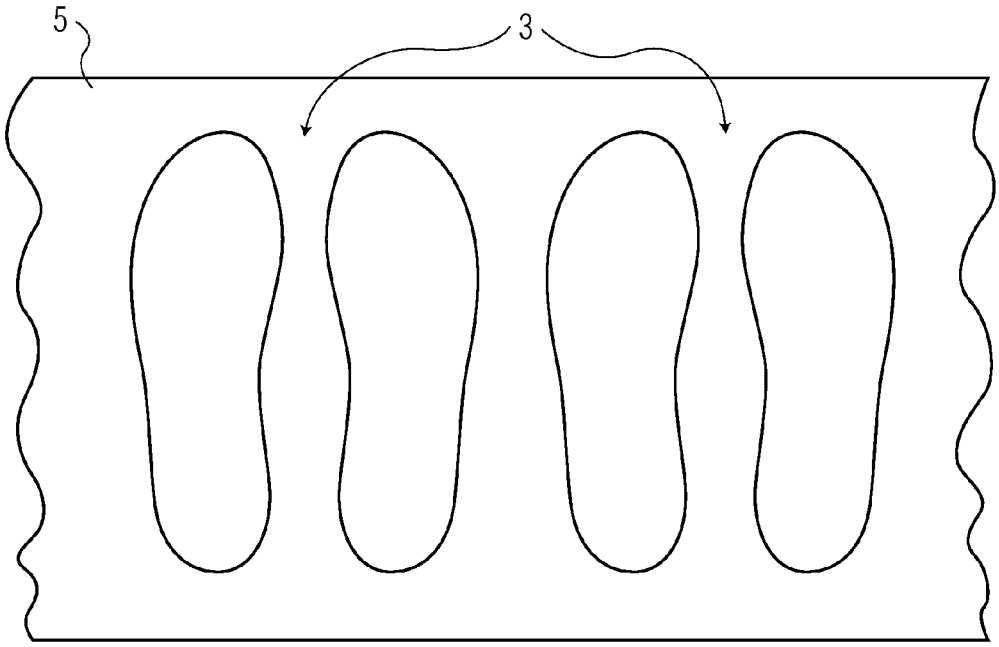
FIG. 1 is a plan view of pairs of outsoles positioned on a conveyor in preparation for application of flocking in accordance with the invention.
Figure 2:
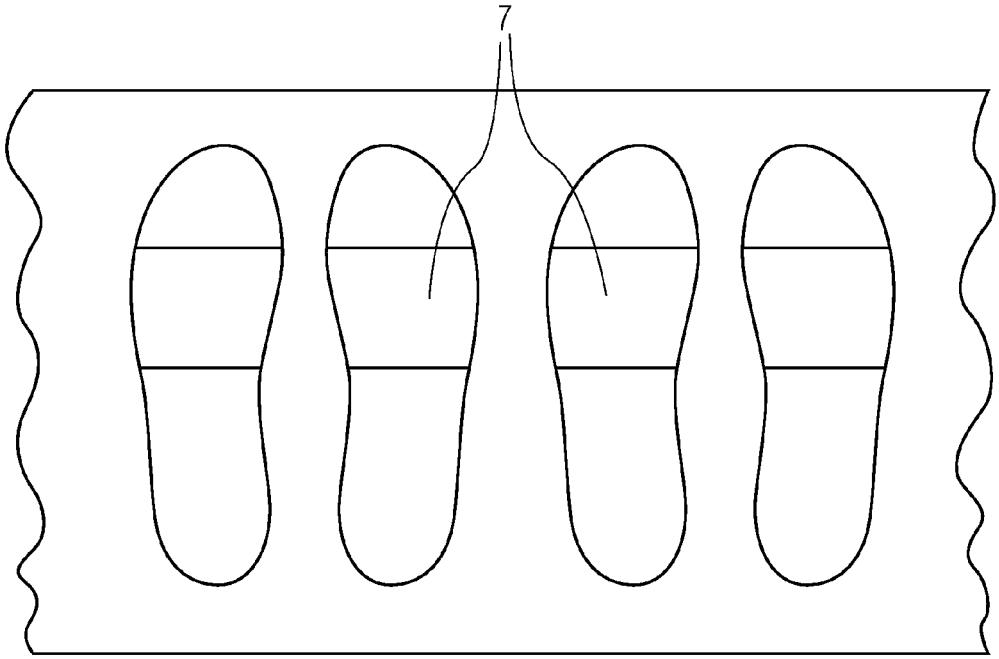
FIG. 2 is a plan view showing the pairs of outsoles in FIG. 1 during a later stage of preparation for flocking.

Referring now to FIG. 1 of the drawings, there are shown two pair of outsoles 3 which are placed, bottom side up on a conveyor belt 5. As seen in FIG. 2, the outsoles 3 may have one or more removable masks 7 applied over portions of the areas of the bottom surfaces of the outsoles 3, that is, over the surfaces which will be exposed when the outsoles 3 are mounted on shoes. The masks 7 can be formed from a paper or plastic laminate material coated with an adhesive having a greater affinity for the paper or plastic laminate material then for the material from which the outsoles 3 are fabricated.

Figure 3:
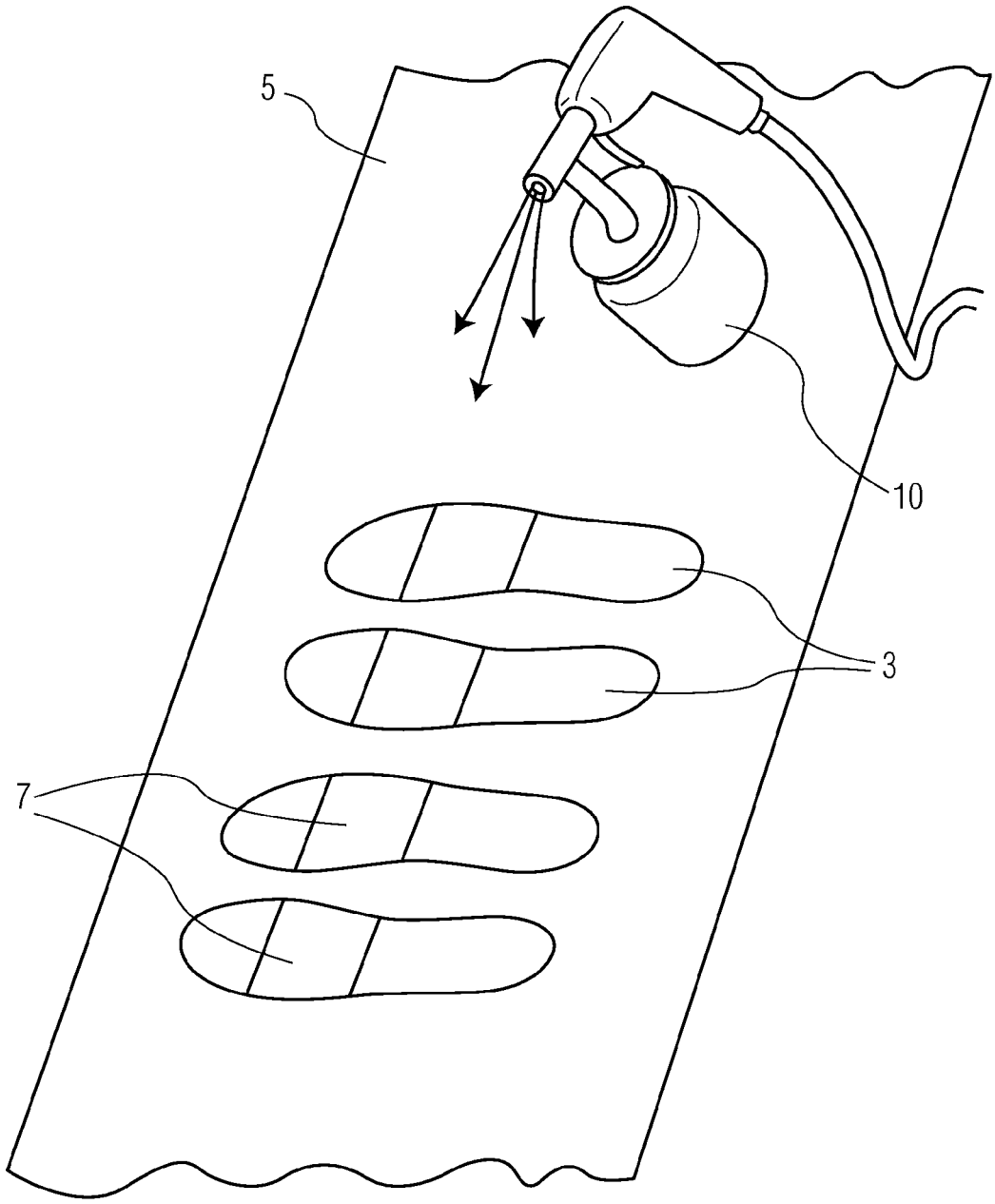
FIG. 3 is a perspective view showing the pairs of outsoles in FIG. 1 during a still later stage of preparation for flocking.

Referring now to FIG. 3, the conveyor belt 5 carries the outsoles 3, which are optionally partially covered with masks 7, to a station at which glue or other adhesive is sprayed onto the exposed surfaces of the outsoles 3 and the masks 7 which partially cover the outsoles 3. The glue or adhesive can, but need not be, a thermosetting one. The surfaces of the outsoles which are to receive the flocking fibers can be coated with a layer of an adhesive or glue by spraying the adhesive or glue with a manually operated sprayer 10. Alternatively fixed sprayers (not shown) may be mounted over the conveyor for spraying the adhesive or glue onto the exposed surfaces of the outsoles 3 and the masks 7 as the outsoles 3 pass beneath the sprayers.

Referring now to FIGS. 4 and 4*a*, the glue covered outsoles 3 are then removed from the conveyor and placed glue side (outer surface) down on one or more outsole trays 9 mounted atop a high pressure flocking fixture 11. The trays 9 are preferably removable from the fixture 11 for ease of handling. Trays 9 can be provided with openings in various sizes to accommodate outsoles of correspondingly different sizes.

The high pressure flocking fixture 11 has a hollow substantially rectangular housing 13 with an upper surface 15 forming a table having one or more openings over which the trays 9 are placed. The trays 9 preferably have openings substantially congruent to the shapes of the outsoles.

The tray openings may be provided with supports for the outsoles to prevent them from falling through the openings or bending. Screens or grids 12 are preferably mounted as supports within the openings in the trays 9. The screens or grids 12 have openings large enough to permit the flocking fibers to pass therethrough for impacting upon the glue which has been sprayed onto the now downward facing outer surfaces of the outsoles. The trays 9 are placed onto the table with the openings in the trays in registration with the openings in the table so that the flocking fibers can be propelled from the chamber 17 through the openings in the table and the openings in the tray 9 to collide with the adhesive on the surfaces of the outsoles 3.

Beneath the table surface 15 of the high pressure flocking fixture 11 is a substantially rectangular air-tight chamber 17 formed within the housing 13. The flocking fibers to be applied to the outsole are inserted into the chamber 17.

High pressure piping 19 leads from a source 23 of gas having a pressure greater than the atmospheric pressure surrounding the fixture 11. The gas may be air or any other substantially insert gas such as nitrogen. The gas source 23 may include a tank which has been filled with the gas under pressure or, preferably, an air compressor. The pressurized gas is conveyed into the chamber 17 for pressurizing the chamber 17. Valve 21 mounted in series with the piping 19 enables gas under pressure to enter the chamber under manual or automatic control. The valve 21 can be connected to a switch 27 for electromechanically opening the valve 21 when energized and enabling the valve 21 to close when not energized.

An actuator 25 for enabling an operator to operate the switch 27 for selectively opening and closing the valves 21 can be provided in the form of a floor pedal for foot control, or a lever placed at an elevation below the table top suitable for actuation by the operator's knee or above the table top for hand use.

Upon actuation of the switch 27, high pressure air jets enter the high pressure chamber starting from the inlet. After hitting a deflector in the form of a pressure plate on the underside of the table top inside of the chamber, the jet of air is deflected downwardly. The resulting increase in pressure within the chamber forces the flocking fibers to exit the openings in the table top and travel through the screens or grates in the trays on which the outsoles are supported with great force whereby the flocking fibers collide with and impact upon, and become embedded in, the layer of glue or adhesive previously applied to each outsole 3. The outsoles may be manually held down by the operator to prevent them from moving as the flocking fibers are propelled against the outsoles by the increase in pressure. Alternatively, weights or covers may be placed over the outsoles to prevent them from movement during the application of flocking.

After the flocking fibers have been applied to the outsoles as described above, the outsoles are removed from the outsole trays on the fixture at which time the paper covers or masks previously applied to shield one or more sections of the outsole surface from the application of flocking are removed.

Referring now to FIG. 5, the outsoles are then placed on a conveyor, preferably with the flocking face up for passage through a heating station at which the glue is dried and/or set.

As shown in FIG. 6, excessive flocking fiber on the outsoles may be manually removed with an air jet gun for imparting a neatly trimmed appearance to the flocking.

The flocked and trimmed soles are then attached to uppers in a conventional manner to form a finished shoe.

It is to be appreciated that other and further modifications and variations may be made to the embodiments herein disclosed without departing from the spirit and scope of the invention. For example, although two openings are provided in the housing for applying flocking fibers to two outsoles at a time, one, three or more openings may be provided for treating a corresponding number of outsoles with flocking in a single operation. Moreover, each tray may have a single opening for a single outsole, or may have several openings to accommodate a plurality of outsoles.

What is claimed is:

1. A method of applying flocking fibers to the outsole of a shoe comprising, inserting flocking fibers into a chamber within a housing, coating a surface of said outsole with an adhesive, placing said outsole outside of said chamber with said surface of said outsole over an opening in said housing in communication with said chamber, increasing the pressure in said chamber to a level greater than the pressure outside of said chamber sufficiently to force said flocking fibers to exit said chamber through said opening without subjecting said flocking fibers to any electric field, and to collide with said adhesive on said surface of said outsole whereby at least some of said flocking fibers adhere to said adhesive.

2. A method of applying flocking fibers to the outsole of a shoe according to claim 1 further comprising heating said adhesive after said flocking fibers have been adhered thereto for causing said adhesive to set.

3. A method of applying flocking fibers to the outsole of a shoe according to claim 1 further comprising covering at least one area of said surface of said outsole with a mask before coating said surface of said outsole with said adhesive to prevent said at least one area from receiving said adhesive, and removing said mask from said outsole after causing said flocking fibers to collide with said adhesive on said surface of said outsole, whereby said outsole is only partially covered with flocking fibers.

4. A method of applying flocking fibers to the outsole of a shoe according to claim 3 further comprising coating said mask with an adhesive having a greater affinity for the mask than for the outsole before covering said at least one area of said surface of said outsole with said mask.

5. A method of applying flocking fibers to the outsole of a shoe according to claim 1 further comprising removing excess flocking fibers from said outsole after said adhesive sets.

6. A method of applying flocking fibers to the outsole of a shoe according to claim 1 further comprising, directing a jet of a gas into said chamber, and deflecting said jet of gas after it enters said chamber to increase the pressure therein in order to force said flocking fibers to exit from the chamber through the said opening in said housing.

7. A method of applying flocking fibers to the outsole of a shoe according to claim 1 further comprising, placing said outsole on a tray over an opening in said tray, and placing said tray over said opening in said housing with said opening in said tray in registration with said opening in said housing.

8. A method of applying flocking fibers to the outsole of a shoe according to claim 7 further comprising mounting a support for said outsole within said opening in said tray before placing said outsole on said tray over said opening in said tray.

9. A method of applying flocking fibers to the outsole of a shoe according to claim 8 wherein said support comprises a screen.

* * * * *